US008101273B2

(12) United States Patent
Jacquet et al.

(10) Patent No.: US 8,101,273 B2
(45) Date of Patent: Jan. 24, 2012

(54) COATING COMPRISING LAYERED STRUCTURES OF DIAMOND LIKE NANOCOMPOSITE LAYERS AND DIAMOND LIKE CARBON LAYERS

(75) Inventors: Jean-Marie Jacquet, Brussels (BE); Wim Pappaert, Sint-Pieters-Leeuw (BE); Marc Sercu, Roeselare (BE); Koen Vanhollebeke, Lille (FR)

(73) Assignee: Sulzer Metaplas GmbH, Bergisch Gladbach (DE)

( * ) Notice: Subject to any disclaimer, the term of this patent is extended or adjusted under 35 U.S.C. 154(b) by 861 days.

(21) Appl. No.: 11/915,242

(22) PCT Filed: May 24, 2006

(86) PCT No.: PCT/EP2006/004912

§ 371 (c)(1),
(2), (4) Date: Dec. 27, 2007

(87) PCT Pub. No.: WO2006/125613

PCT Pub. Date: Nov. 30, 2006

(65) Prior Publication Data

US 2008/0193649 A1 Aug. 14, 2008

(30) Foreign Application Priority Data

May 26, 2005 (EP) ..... 05104514

(51) Int. Cl.
*C23C 16/00* (2006.01)

(52) U.S. Cl. ..... 428/408; 427/577; 428/216; 428/336

(58) Field of Classification Search ..... 427/577; 428/212, 216, 336, 408
See application file for complete search history.

(56) References Cited

U.S. PATENT DOCUMENTS

| | | | | |
|---|---|---|---|---|
| 4,619,865 | A * | 10/1986 | Keem et al. | 428/698 |
| 5,352,493 | A * | 10/1994 | Dorfman et al. | 427/577 |
| 5,508,368 | A | 4/1996 | Knapp et al. | |
| 6,200,675 | B1 * | 3/2001 | Neerinck et al. | 428/336 |
| 6,228,471 | B1 * | 5/2001 | Neerinck et al. | 428/212 |

FOREIGN PATENT DOCUMENTS

| | | | |
|---|---|---|---|
| EP | 0 651 069 | A1 | 5/1995 |
| EP | 0 856 592 | A1 | 8/1998 |
| WO | WO 98/33948 | A1 | 8/1998 |
| WO | 00/75394 | * | 12/2000 |

OTHER PUBLICATIONS

A. A. Voevodin et al., "Architecture of multilayer nanocomposite coatings with super-hard diamond-like carbon layers for wear protection at high contact loads", International Conference on Wear of Materials, vol. 203-204 (1997), pp. 516-527.

* cited by examiner

*Primary Examiner* — Archene Turner
(74) *Attorney, Agent, or Firm* — Foley & Lardner LLP

(57) ABSTRACT

The invention relates to a coating comprising a number of layered structures, each such layered structure comprising—a first layer comprising a diamond like nanocomposite layer, said first layer comprising carbon, hydrogen, oxygen and silicon; a second layer comprising a diamond like carbon layer. The number of layered structure is higher than 4 and is preferably between 10 and 100. The invention further relates to a method to deposit such a coating.

11 Claims, 1 Drawing Sheet

COATING COMPRISING LAYERED STRUCTURES OF DIAMOND LIKE NANOCOMPOSITE LAYERS AND DIAMOND LIKE CARBON LAYERS

FIELD OF THE INVENTION

The invention relates to an improved coating comprising layers of diamond like nanocomposite and diamond like carbon.

BACKGROUND OF THE INVENTION

It is well known in the art to use diamond like carbon coatings or diamond like nanocomposite coatings to increase the hardness or the wear resistance of a substrate.

WO98/33948 describes a layered coating comprising two layered structures, each layered structure comprising a diamond like nanocomposite layer and a diamond like carbon layer.

For some applications, the wear resistance of such a layered coating is insufficient. Therefore, there is a need to develop coatings having increased wear resistance.

SUMMARY OF THE INVENTION

It is an object of the present invention to provide an improved coating comprising layers of diamond like carbon and diamond like nanocomposite.

It is another object of the invention to provide a coating having increased wear resistances and reduced internal stresses.

According to a first aspect of the present invention a coating comprising layers of diamond like nanocomposite and diamond like carbon is provided.

The coating comprises a number of layered structures. Each layered structure comprises

- a first layer, located closest to the substrate, comprising a diamond like nanocomposite layer.
- a second layer comprising a diamond like carbon layer.

The number of layered structures is higher than 4 and is preferably between 5 and 100. More preferably, the number of layered structures is between 10 and 30, as for example 12 or 15.

The coating according to the present invention is characterized by a high wear resistance.

For the purpose of this invention, the number of rotations to wear through the coating divided by the thickness of the coating is used as a measure of the wear resistance of the coating.

The number of rotations to wear through the coating is determined by a ball crater test. In this test a steel ball covered with an abrasive fluid is rotating against the sample and is wearing a crater into the coating under investigation.

In the ball crater test 3 ball craters are formed, a first crater not through the coating, a second crater through the coating and a third crater as close as possible to the coating—substrate interphase.

The number of rotations is 80 rpm, the load is 0.25 N and the abrasive particles have a size of 1 μm.

The number of rotations to wear through the coating is determined by a linear fit of the crater depth versus the number of rotations.

Preferably, the wear resistance of the coating according to the present invention is higher than 1000 rotations/μm, for example 1020 rotations/μm. More preferably, the wear resistance of the coating is higher than 1200 rotations/μm as for example 1400 rotations/μm.

Surprisingly, it has been found that by increasing the number of layered structures, the wear resistance of the coating is improved.

The wear resistance of two coatings having the same total thickness is compared: the first coating has a high number of layered structures; the second coating has a low number of layered structures.

It has been found that the wear resistance of the coating having a high number of layered structures is much higher than the wear resistance of the coating having a low number of layered structures.

Although the applicant does not want to be bound to any theory, it seems that by increasing the number of layered structures, the internal stresses within the coating are better distributed over the thickness of the coating.

The thickness of the first layer comprising a diamond like nanocomposite layer is preferably between 0.05 and 1 μm, more preferably the thickness is between 0.05 and 0.5 μm as for example 0.1 or 0.3 μm.

The thickness of the second layer comprising a diamond like carbon layer is preferably between 0.05 and 1 μm, more preferably the thickness is between 0.05 and 0.5 μm as for example 0.1 or 0.3 μm.

The thickness of the second layer $t_2$ is preferably larger than the thickness of the first layer $t_1$.

Preferably, the ratio of the thickness $t_2$ over the thickness $t_1$, $t_2/t_1$, is between 1 and 3, as for example between 1 and 1.5.

The coating may comprise a first intermediate layer between the first layer and the second layer. The first intermediate layer has a composition that is gradually changing from a diamond like nanocomposite composition to a diamond like carbon composition.

The coating according to the present invention may comprise a second intermediate layer between two consecutive layered structures. The composition of the second intermediate layer is gradually changing from a diamond like carbon composition to a diamond like nanocomposite composition.

With diamond like carbon (DLC) is meant any hard carbon-based coating such as hydrogenated amorphous carbon (a-C:H) coatings and metal containing hydrogenated amorphous carbon coatings.

With diamond like nanocomposite is meant any hard carbon coating comprising C, H, Si and O.

Preferably, the diamond like nanocomposite layer preferably comprises in proportion to the sum of C, Si and O in at %, 40 to 90% C, 5 to 40% Si, and 5 to 25% O.

The diamond like nanocomposite layer comprises preferably two interpenetrating networks, one network being an a-C:H diamond like network and the other an a-Si:O glass-like network.

To influence the properties of the coating such as the electrical conductivity one or more layers of the coating, such as the diamond like carbon layer, the diamond like nanocomposite layer or one or more of the intermediate layers, can be doped with one or more transition metal such as Ti, Zr, Hf, V, Nb, Ta, Cr, Mo, W, Mn, Re, Fe, Co, Ir, Ni, Pd and Pt.

Other dopants may comprise B, Li, Na, Si, Ge, Te, O, Mg, Cu, Al, Ag and Au.

Preferred dopants are W, Zr and Ti.

Any of the layers of the coating can contain 0.5 to 5 at % of an inert gas such as Ne, Ar or Kr.

According to a second aspect of the present invention a substrate coated with a coating layer as described above is provided.

The coating according to the present invention is in particular suitable to coat substrates requiring a high wear resistance.

Preferred substrates to be coated are parts of an injection mould, such as the mirror and/or stamper of injection moulds for the manufacturing of disc-like information carriers and the venting ring of an injection mould.

According to a third aspect of the present invention a method to manufacture a coated substrate is provided.

The method comprises the steps of providing a substrate;

depositing at least four layered structures, each layered structure comprising a first layer having a thickness $t_1$ and a second layer having a thickness $t_2$, said first layer comprising a diamond like nanocomposite layer comprising carbon, hydrogen, oxygen and silicon and said second layer comprising a diamond like carbon layer, said thickness $t_2$ being higher than said thickness $t_1$, said deposition of a layered structure comprising depositing in a vacuum chamber a first layer comprising a diamond like nanocomposite layer, starting from an organic precursor containing the elements C, H, Si and O;

depositing in said vacuum chamber a second layer comprising a diamond like carbon layer, starting form a hydrocarbon.

Preferably, the number of layered structures is between 5 and 100. More preferably, the number of layered structures is between 10 and 30.

Before the deposition of the coating, the substrate can be subjected to a pretreatment process such as an ion etching process.

The ion etching process may for example comprise the bombardment of the substrate by ions of an inert gas such as argon.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
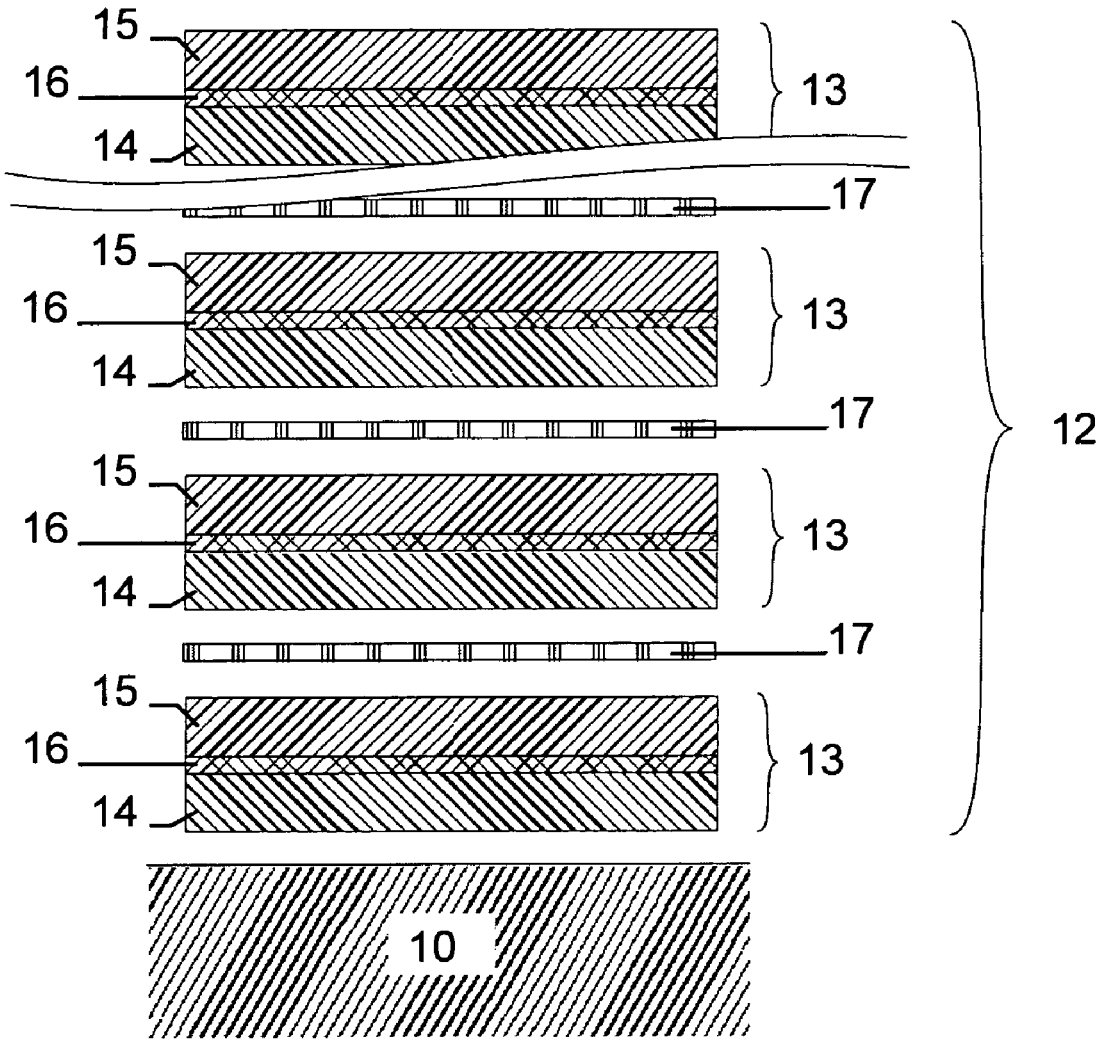
FIG. 1 is a schematic representation of a substrate having a coating according to the present invention.

FIG. 1 schematically represents a substrate 10 having a coating 12 according to the present invention.

The coating 12 comprises a number of layered structures 13, each layered structure 13 comprising a first layer 14 comprising a diamond like nanocomposite layer, said first layer comprising carbon, hydrogen, oxygen and silicon;

a second layer 15 comprising a diamond like carbon layer.

The first layer 14 is located closest to the substrate 10.

The coating 12 may comprise a first intermediate layer 16 between the first layer 14 and the second layer 15. The first intermediate layer 16 has a composition that is gradually changing from a diamond like nanocomposite composition to a diamond like carbon composition.

Possibly, the coating 12 may comprise a second intermediate layer 17 between two consecutive layered structures 13. The composition of the second intermediate layer is gradually changing from a diamond like carbon composition to a diamond like nanocomposite composition.

On top of the outermost layered structure 13 a top layer can be deposited. The top layer can be chosen in order to influence the properties of the coating 12. Possible top layers comprise diamond like nanocomposite coatings or antisticking coatings.

To evaluate the coating according to the present invention, some different coatings are compared.

Coating 1 is a reference coating comprising 3 layered structures; coating 2 is a coating according to the present invention comprising 10 layered structures; coating 3 is a coating according to the present invention comprising 12 layered structures and coating 4 is a coating according to the present invention comprising 15 layered structures.

The thickness of the different layers of coatings 1 to 4 is given in table 1 to table 4.

The $1^{st}$ layered structure is the layered structure located closest to the substrate.

The wear resistance of the different coatings is given in table 5.

TABLE 1

Thickness of the different layers of coating 1

| | | |
|---|---|---|
| $1^{st}$ layered structure | DLN | 0.6 μm |
| | DLC | 1.0 μm |
| $2^{nd}$ and $3^{rd}$ layered structure | DLN | 0.9 μm |
| | DLC | 1.0 μm |

TABLE 2

Thickness of the different layers of coating 2

| | | |
|---|---|---|
| $1^{st}$ layered structure | DLN | 0.6 μm |
| | DLC | 0.3 μm |
| $2^{nd}$ till $10^{th}$ layered structure | DLN | 0.25 μm |
| | DLC | 0.3 μm |

TABLE 3

Thickness of the different layers of coating 3

| | | |
|---|---|---|
| $1^{st}$ layered structure | DLN | 0.6 μm |
| | DLC | 0.3 μm |
| $2^{nd}$ till $12^{th}$ layered structure | DLN | 0.3 μm |
| | DLC | 0.12 μm |

TABLE 4

Thickness of the different layers of coating 4

| | | |
|---|---|---|
| $1^{st}$ layered structure | DLN | 0.6 μm |
| | DLC | 0.3 μm |
| $2^{nd}$ till $15^{th}$ layered structure | DLN | 0.3 μm |
| | DLC | 0.12 μm |

TABLE 5

Wear resistance of coating 1 to coating 4

| | Wear resistance (rotations/μm) |
|---|---|
| Coating 1 | 1006 (stdev = 158) |
| Coating 2 | 1300 (stdev = 249) |
| Coating 3 | 1288 (stdev = 117) |
| Coating 4 | 1302 (stdev = 231) |

From table 5 can be concluded that the wear resistance of a coating having a high number of layered structures (as for example 10 layered structures (example 2), 12 layered structures (example 3) or 15 layered structures (example 4)) is considerably higher than the wear resistance of a coating having 3 layered structures (example 1).

Furthermore, the wear resistance of a coating can be improved by increasing the thickness or the second layer compared to the thickness of the first layer.

The wear resistance of two different coatings (coating 5 and coating 6) is compared. Each coating comprises 10 layered structures; for coating 5, the ratio of the thickness of the second layer over the thickness of the first layer, $t_2/t_1$ is ⅓; for coating 6, the ratio of the thickness of the second layer over the thickness of the first layer, $t_2/t_1$ is 3.

Test results showed that the wear resistance of the coating of example 6 is 50% higher than the wear resistance of the coating of example 5.

The invention claimed is:

1. A coating comprising a number of layered structures, each such layered structure comprising a first layer having a thickness $t_1$, said first layer comprising a diamond like nanocomposite layer comprising carbon, hydrogen, oxygen and silicon;

a second layer having a thickness $t_2$, said second layer comprising a diamond like carbon layer;

wherein said number of layered structures is higher than 4 and said thickness $t_2$ is higher than said thickness $t_1$.

2. A coating according to claim 1, whereby the ratio of the thickness $t_2$ over the thickness $t_1$ ($t_2/t_1$) is between 1 and 3.

3. A coating according to claim 1, whereby said coating has a wear resistance higher than 1000 rotations/μm, said wear resistance being determined by the number of rotations divided by the total thickness of the coating.

4. A coating according to claim 1, whereby said number of layered structures is between 10 and 100.

5. A coating according to claim 1, whereby said first layer has a thickness between 0.05 and 1 μm.

6. A coating according to claim 1, whereby said second layer has a thickness between 0.05 and 1 μm.

7. A coating according to claim 1, whereby said layered structure further comprises a first intermediate layer between said first and said second layer, the composition of said first intermediate layer is gradually changing from a diamond like nanocomposite composition to a diamond like carbon composition.

8. A coating according to claim 1, whereby said coating further comprises a second intermediate layer between two consecutive layered structures, the composition of said second intermediate layer is gradually changing from a diamond like carbon composition to a diamond like nanocomposite composition.

9. A substrate covered at least partially with a coating layer according to claim 1.

10. A method of manufacturing a coated substrate, said method comprises the steps of providing a substrate;

depositing at least four layered structure, each layered structure comprising a first layer having a thickness $t_1$ and a second layer having a thickness $t_2$, said first layer comprising a diamond like nanocomposite layer comprising carbon, hydrogen, oxygen and silicon and said second layer comprising a diamond like carbon layer, said thickness $t_2$ being higher than said thickness $t_1$, said deposition of a layered structure comprising depositing in a vacuum chamber a first layer comprising a diamond like nanocomposite layer, starting from an organic precursor containing the elements, C, H, Si and O;

depositing in said vacuum chamber a second layer comprising a diamond like carbon layer, starting form a hydrocarbon.

11. A method according to claim 10, whereby between 10 and 100 layered structures are deposited.

* * * * *